US005367724A

United States Patent [19]

Coccagna

[11] Patent Number: 5,367,724

[45] Date of Patent: Nov. 29, 1994

[54] BATHING PLATFORM FOR THE DISABLED

[76] Inventor: Albert J. Coccagna, 2451 Greensward N., Warrington, Pa. 18976

[21] Appl. No.: 183,865

[22] Filed: Jan. 21, 1994

[51] Int. Cl.[5] ..... A47K 3/12

[52] U.S. Cl. ..... 4/571.1; 4/573.1

[58] Field of Search ..... 4/571.1, 572.1, 573.1, 4/574.1, 575.1, 576.1, 577.1, 578.1, 579.1

[56] References Cited

U.S. PATENT DOCUMENTS

| | | | |
|---|---|---|---|
| 1,513,440 | 4/1924 | Wirt . | |
| 1,846,492 | 5/1930 | Johnson . | |
| 1,883,660 | 6/1931 | Feldman . | |
| 2,700,776 | 2/1955 | Walters | 4/572.1 |
| 2,719,306 | 10/1955 | Levitt | 4/572.1 |
| 2,817,095 | 12/1957 | Jeffries | 4/576.1 |
| 2,965,153 | 12/1960 | Purcell, Sr. | 4/578.1 |
| 3,855,646 | 12/1974 | Glickman | 4/578.1 |
| 4,166,297 | 9/1979 | Saleeby | 4/578.1 |
| 4,168,549 | 9/1979 | Davies | 4/578.1 |
| 5,297,300 | 3/1994 | Sheu | 4/572.1 |

*Primary Examiner*—Henry J. Recla
*Assistant Examiner*—Charles R. Eloshway
*Attorney, Agent, or Firm*—Eric A. LaMorte

[57] ABSTRACT

A bathing support device for use in bathing disabled persons that includes a water permeable platform upon which the disabled person can lay. The platform is supported a predetermined height over the bathtub by front and rear leg assemblies. The front leg assemblies extend from the platform and engage the floor proximate the front of the bathtub. As such, the front leg assemblies can cause no damage to the bathtub or its finish. The rear leg assembly extend from the platform and engage the bottom surface of the bathtub, which can support the forces applied by the rear leg assembly without damage. The orientation of the legs is designed to provide a stable support for the disabled person, thereby removing the concerns and dangers of having the support tip while the disabled person is supported by the platform.

19 Claims, 6 Drawing Sheets

BATHING PLATFORM FOR THE DISABLED

BACKGROUND OF THE INVENTION

I. Field of the Invention

The present invention is directed in general toward bathing platforms for use in bathing disabled or infirm persons who are physically incapable of bathing themselves. More particularly, the present invention is directed toward bathing platforms that can be used in conjunction with a standard size bathtub so as to elevate a disabled person to a more safe and accessible position for bathing.

II. Prior Art

There are many people who, due to their age, an accident, birth defect or disease, are physically incapable of bathing themselves unassisted. With infants, the child is simply lifted into a small tub and given a bath with a sponge or wash cloth. However, with full grown adults, the task becomes infinitely more complex. Traditionally, disabled adults are carried to a bathtub where they are placed in a small seat or harness to support their weight. The person is then bathed and lifted out of the bathtub when done. As can be ascertained, this procedure is physically strenuous, time consuming and, most of all, highly uncomfortable for the person being bathed. In many situations where the person to be bathed challenges the physical strength of the person administering the bath, the traditional ways of administering a bath become dangerous. In such situations, the person to be bathed may be accidentally dropped, especially since both the person being bathed and the surroundings are wet and slick with soap. Similarly, the person administering the bath may be injured by straining his/her back or pulling a muscle while lifting the disabled person from the tub. Additionally, even if the disabled person is not a physical challenge to lift, it is difficult to bathe a disabled person in a standard bathtub. Such a procedure requires the bather to kneel next to the tub for a substantial period of time, manipulate the body of the disabled person with one hand and wash the disabled person with the other. This procedure produces great discomfort in the person administering the bath. Yet another concern is the bathtub itself. Almost without exception, bathtubs are hard, slick structures with rapidly upwardly curving sides. Sitting or laying in a bathtub is often uncomfortable and difficult for even the healthiest of people. Disabled people who need help when bathing are often restricted to bed. This often causes bed sores and a general loss of muscle tone. When such a person is placed in a standard bathtub, the hardness of the surfaces and the harshness of its structure may be extremely uncomfortable to the disabled person. As a result, disabled persons often dread the thought of being bathed.

As can be seen, there exists a need for an apparatus that would decrease the discomforts and difficulties associated with administering a bath to a disabled person. Although the prior art record is replete with devices intended to assist the disabled, the prior art lacks a large selection of devices that assist in the bathing of a disabled person. The prior art that does address the problem is typically directed toward bathing infants. Patents exemplifying this prior art include U.S. Pat. No. 1,513,440, to Wirt entitled TABLE ATTACHMENT FOR BATHTUBS; U.S. Pat. No. 1,846,492 to Johnson entitled FOLDING FURNITURE; and U.S. Pat. No. 1,883,660 to Feldman entitled INFANT'S COLLAPSIBLE BATHTUB. All these prior art references address a means for supporting an infant above a bathtub. Since the devices are all designed to support the relatively light weight of an infant, little concern is given to damaging the below lying tub. Consequently, these prior art supports gain their stability by engaging the front rim of the bathtub and the wall behind the bathtub. Such a structure is safe for an infant's weight, but is both dangerous and destructive if used to support the weight of an adult. If used to support the weight of an adult, a structure that engages the front rim of a bathtub and the wall behind a bathtub would act to push the bathtub away from the wall. This may cause cracks in the grout seal surrounding the bathtub which, in turn, would cause water to leak around the bathtub. Additionally, the weight of a grown adult being transferred to the rim of the tub and the wall behind the tub, would cause damage to both. Often the wall behind a tub is nothing more than painted or tiled sheet rock. The weight of a person being applied against such a wall could crack the tiles and cause holes in the sheet rock. Similarly, many modern bathtubs are made of fiberglass or plastic. The weight of a person being applied against the rim of such a bathtub could crack the tub, rendering it useless or otherwise damage the finish of the tub, making it less attractive.

It is, therefore, an objective of the present invention to provide an apparatus for supporting a disabled adult over a bathtub in a position that is both comfortable to the disabled person and easily accessible to the person administering the bath.

It is a further objective of the present invention to provide a bathing support that is lightweight, easy to use, easy to adjust, easy to install and remove and will not damage the bathtub or its surroundings.

SUMMARY OF THE INVENTION

The present invention is a bathing support device for use in bathing disabled persons. The bathing support device includes a water permeable platform upon which the disabled person can lay. By positioning a disabled person on the platform above the bathtub, the disabled person can be bathed more efficiently and with much more comfort than if the disabled person where placed into the tub. The platform is supported a predetermined height over the bathtub by front and rear leg assemblies. The front leg assemblies extend from the platform and engage the floor proximate the front of the bathtub. As such, the front leg assemblies can cause no damage to the bathtub or its finish. The rear leg assemblies extend from the platform and engage the bottom surface of the bathtub. Bathtubs are designed to support the weight of adults upon their bottom surfaces. As a result, the rear leg assemblies do not damage the bathtub. The orientation of the legs is designed to provide a stable support for the disabled person. Thereby removing the concerns and dangers of having the support tip while the disabled person is supported by the platform.

The platform lays generally in one plane. The front and rear leg assemblies are pivotably attached to the platform so that they may fold against the platform in generally the same plane as the platform. This construction enables the present invention device to be easily placed, removed or stored within a shower stall.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Although the present invention can be used to support any object, such as a dog, cat or infant, over a bathtub the present invention is especially adapted for use in supporting a disabled adult or adolescent over a bathtub for the purposes of administering a bath. As a result, the present invention will be described in conjunction with bathing a disabled adult or adolescent.

Figure 1:
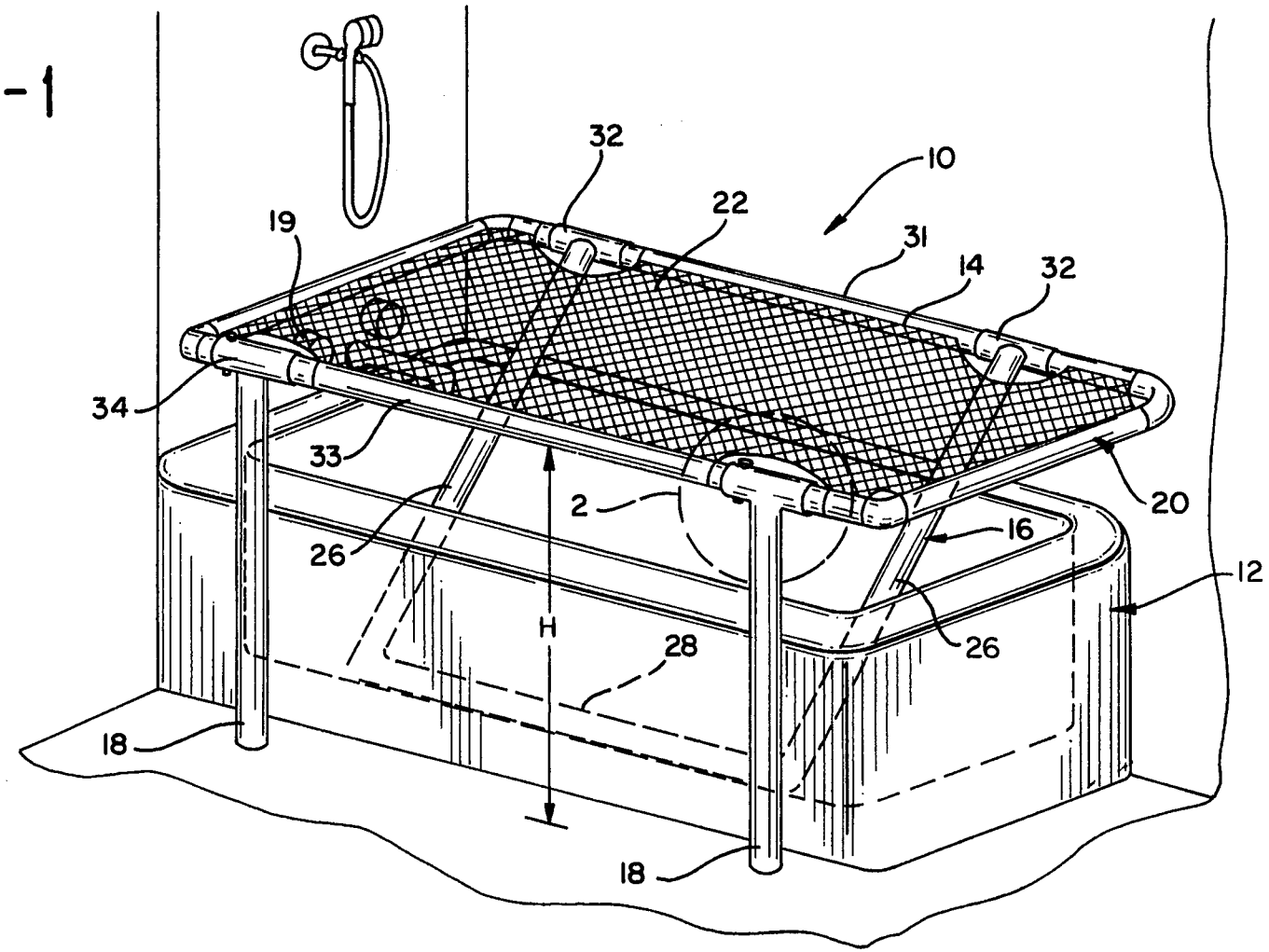
FIG. 1 is a perspective view of one preferred embodiment of the present invention shown in conjunction with a bathtub to facilitate discussion and consideration.

Referring to FIG. 1, there is shown one preferred embodiment of the present invention apparatus 10 in conjunction with a traditional bathtub 12 and shower stall. In the shown embodiment, the present invention apparatus 10 is comprised of a planar support 14 suspended over the bathtub 12 by a rear leg assembly 16 and two front leg assemblies 18. The rear leg assembly 16 and the two front leg assemblies 18 combine to hold the planar support 14 a height H above the bathroom floor. Height H can be any preferred height, but is preferably between 28 inches and 48 inches so as to be in a position that is ergonomically efficient for most people. As will be later explained, height H may be selectively adjustable so that the planar support 14 is at a convenient height for the person administering the bath. Also, the height H is preferably selected to suspend the planar support 14 above the operational controls 19, i.e. hot water valve, cold water valve and tub spigot, so that a person lying on the planar support 14 need not be concerned about striking these objects.

The planar support 14 itself is comprised of a rectangular frame 20 made preferably of lightweight, non-corrosive, high strength tubular members, such as aluminum tubing, stainless steel tubing or plastic tubing like polyvinylchloride (PVC). The rectangular frame 20 can be unistructurally formed or assembled in any manner appropriate for the material of the rectangular frame 20, i.e. welded, glued, nailed etc. A flexible support element 22 is suspended between the elements of the rectangular frame 20. The flexible support element 22 may be attached in any manner, such as hooks or the like, to the rectangular frame 20. However, in the shown embodiment, the flexible support element 22 is looped around the elements of the rectangular frame 20 and sewn to itself. In the shown embodiment, the flexible support element 22 is a mesh material such as fine plastic netting. However, the flexible support element 22 can be any material that is both capable of supporting the weight of an adult and is water permeable in its material or construction, thereby allowing the rapid flow of water through the material. A second small sheet of water impervious material 24 (shown in FIG. 3) may be optionally disposed over the flexible support element 22 near the forward most edge of the rectangular frame 20. As will be later explained, the water impervious element 24 helps direct water into the below lying bathtub 12, thereby preventing the flow of water onto the floor.

The rear leg assembly 16 is shown as a single, generally U-shaped structure having two vertical members 26 and a single bottom cross member 28. This construction is preferred because the long cross member 28 contacts the bottom 30 (FIG. 3) of the bathtub 12 across the entire length of the cross member 28. As will be later explained, this long area of contact helps to evenly distribute the forces applied to the rear leg assembly 16 across the bottom 30 (FIG. 3) of the bathtub 12. In an alternate embodiment, the rear leg assembly 16 can be constructed from separate leg members, therefore it will be understood that the shown U-shaped structure merely represents a preferred embodiment that is indicative of the best mode contemplated for this invention.

The two vertical members 26 of the shown rear leg assembly 16 are pivotably coupled to the distal most element 31 of the rectangular frame 20. In the shown embodiment, the distal element 31 is tubular having a round cross section. The two vertical members 26 of the rear leg assembly 16 terminate at tubular eyelets 32 through which the distal element 31 passes. This construction allows the rear leg assembly 16 to freely rotate around the longitudinal axis of the distal element 31. The use of tubular eyelets 32 in connecting the rear leg assembly 16 to the distal element 31 is also only exemplary, and any other functionally equivalent hinged joint may be used in its place and stead.

Figure 2:
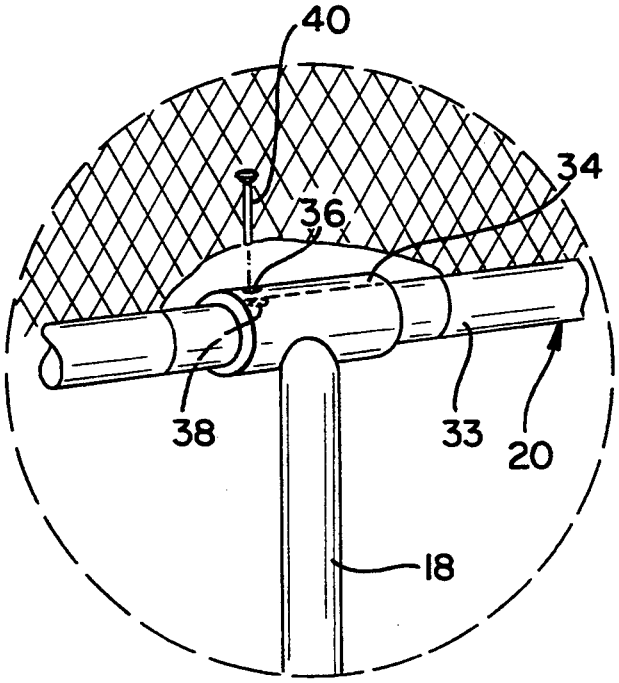
FIG. 2 is an enlarged perspective view of the segment of the present invention contained within circle 2 as shown in FIG. 1.

The two front leg assemblies 18 are pivotably coupled to the proximal element 33 of the rectangular frame 20. Although the two front leg assemblies 18 as shown have a tubular shape, the two front leg assemblies can be of any other alternate construction and may or may not include a widened base to enlarge the area of contact between the leg assemblies and the floor. As with the rear leg assembly 16, the two front leg assemblies 18 also terminate at tubular eyelets 34. Referring to FIG. 2 in conjunction with FIG. 1, it can be seen that the proximal element 33 passes through the tubular eyelet 34, thereby enabling the two front leg assemblies 18 to independently rotate around the longitudinal axis of the proximal element 33. Referring solely to FIG. 2, it can be seen that a first locking aperture 36 may be present in the tubular eyelet 34. A second locking aperture 38 may also be present in the proximal element 33 in the area of the proximal element 33 that is enveloped by the tubular eyelet 34. The first locking aperture 36 and the second locking aperture 38 are positioned so that the two locking apertures 36 align only when the front leg assembly 18 is generally perpendicular to the plane of the rectangular frame 20. A key pin 40 can be passed through the first locking aperture 36 and into the second locking aperture 38, thereby locking the front leg assembly 18 into a single set position, wherein the leg assembly is generally perpendicular to the plane of the rectangular frame 20. The use of the key pin 40 to lock the front leg assembly 18 in one set position relative the rectangular frame 20 helps the stability of the overall apparatus by preventing the front leg assembly 18 from moving out of place while the disabled person is being supported upon the platform.

Although a tubular eyelet 34 hinge is shown with a key pin lock 40, it will be understood that any known pivoting hinge construction may be used as well as any known locking means for locking the pivoting hinge into one set position. Pivoting hinges and locking mechanisms are well known and are replete in the field of folding furniture and folding baby equipment, whereby alternate embodiments need not be explained herein.

Figure 3:
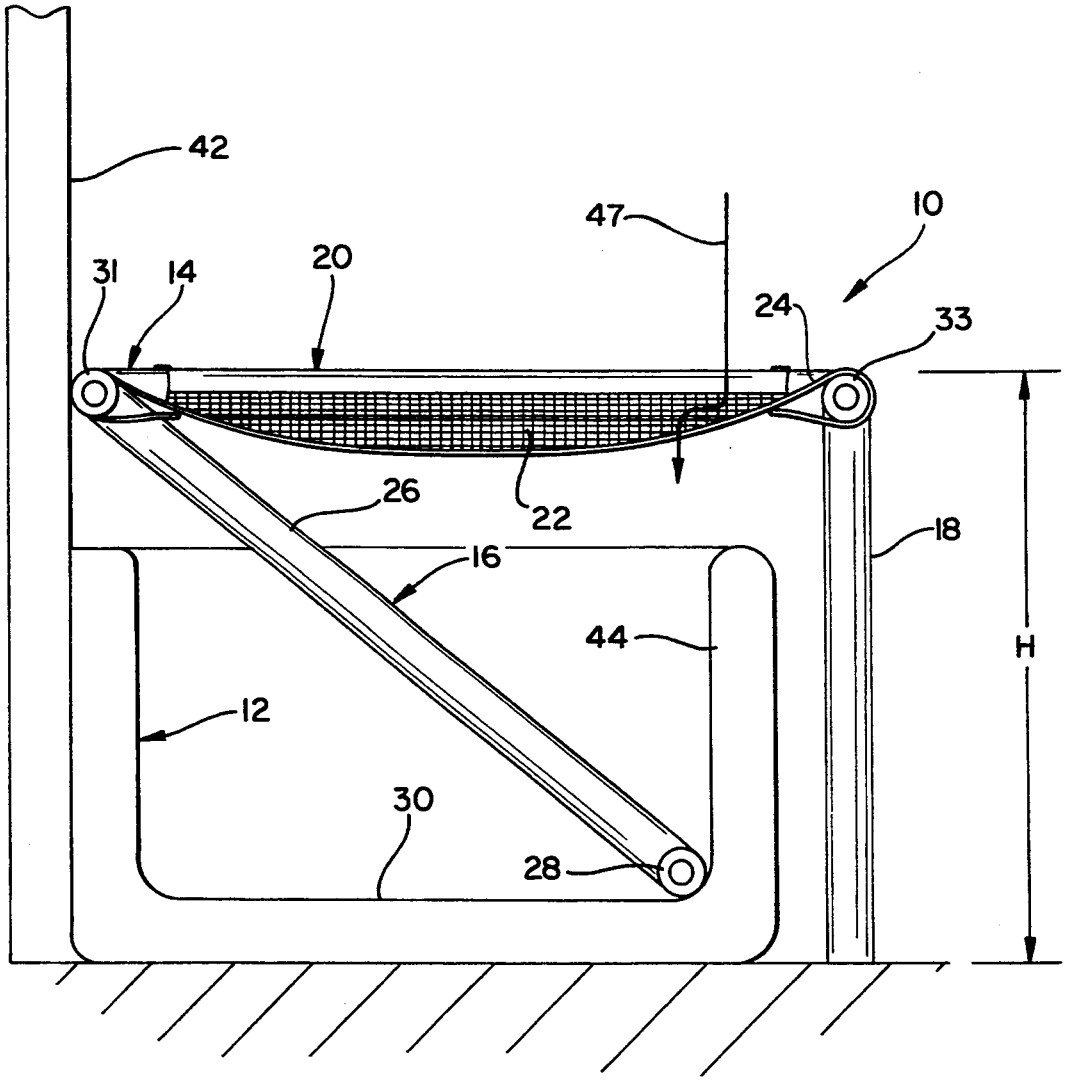
FIG. 3 is a cross-sectional view of the embodiment of the present invention shown in FIG. 1, viewed along section line 3—3.

By referring now to FIG. 3 in conjunction with FIG. 1, the function of the present invention apparatus 10 can be described. When placed in a shower stall above the bathtub, the planar support 14 is positioned in a generally horizontal plane, that is, the rectangular frame 20 is aligned with the horizontal. To support the planar support 14 in that position, the two front leg assemblies 18 are oriented at a perpendicular to the plane of the rectangular frame 20 and are locked into this position, as has been previously explained. The two front leg assemblies 18 rest upon the floor in front of the bathtub 12, thereby supporting the proximal element 33 of the rectangular frame 20 at a height H above the floor.

The rear leg assembly 16 is placed within the confines of the bathtub 12, wherein the vertical members 26 of the rear leg assembly 16 traverse the bathtub beginning at the wall 42 behind the tub and extending at an angle to bottom surface 30 of the bathtub 12 proximate the forward most inner wall 42 of the tub. The angle of the rear leg assembly 16 biases the rectangular frame 20 of the planar support 14 against the wall 42 behind the bathtub 12. This prevents the present invention apparatus 10 from tipping out of the bathtub 12 when a person is placed upon the planar support 14. In a preferred embodiment, the frame 20 contacts the wall 42 at the two back corners of the frame 20. As a result, the frame 20 contacts the wall 42 at the two points on the wall of the highest enclosure strength, i.e. the points where the side walls of the shower enclosure join the rear wall 42. These points on the rear wall are typically well supported by framing studs and are capable of supporting the lateral forces applied against the wall 42 by the frame 20. In an alternate embodiment, entire length of the distal element 31 of the rectangular frame 20 may engage the wall 42 behind the bathtub 12. This large area of contact can disperse the contact forces and prevents the present invention apparatus 10 from damaging the wall 42 or the finish of any tiling that may be present upon that wall. Either described embodiment is advantageous over prior art devices that contact the wall behind the tub at only one or two unsupported positions. Such prior art devices are prevented from supporting the weight of an adult because the weight of an adult would be directed against the wall in a manner that would cause a hole in the wall or otherwise damage the wall and any tiling that may be present.

In the present invention apparatus 10, the angle of the rear leg assembly 16 directs most of the weight of a person on the planar support 14 onto the bottom surface 30 of the bathtub 12. This greatly reduces the forces impinging upon the wall 42, thereby reducing the chances of damage occurring to that surface. The bottom surface 30 of bathtubs are designed to support the weight of large adults plus the weight of the tub itself filled with water. Consequently, the bottom surface 30 of the bathtub 12 can easily support the forces applied to it by the rear leg assembly 16. The cross member 28 of the rear leg assembly 16 engages the bottom surface 30 of the bathtub 12 across the entire length of the cross member 28. As a result, any forces exerted against the bottom surface 30 of the bathtub 12 will be widely distributed, thereby preventing any damage to the finish of the bathtub 12.

As can be seen, the present invention apparatus 10 does not apply any significant forces to the forward most wall 42 of the bathtub 12. Since the forward most wall of many bathtubs is only fiberglass or plastic, the walls of many tubs using prior art devices would be damaged if an adult's weight was applied to those prior art devices. The present invention apparatus 10 has no such weight limitations and can hold the weight of an adult without damage to the tub or to the walls surrounding the tub.

When a disabled adult is placed upon the planar support 14, the flexible support elements 22 that actually contact the disabled person bow slightly downward due to the weight of the disabled person. Taking advantages of this geometry, a sheet of impervious material 24 may be placed over the flexible support elements 22 in an area adjacent to the proximal element 33 of the rectangular frame 20. Since the two front leg assemblies 18 of the present invention apparatus 10 rest upon the floor in front of the bathtub 12, the planar support 14 may extend over the forward edge of the bathtub 12. As a result, any bath water that passes through the planar support 14 in the region of the overhang may not fall into the bathtub 12. By placing the sheet of water impervious material 24 on the planar support 14 over the area of the tub overlap, any water striking the water impervious sheet would be directed into the bathtub 12, as shown by arrow 47. The flow of water into the tub is helped by the downward slant of the flexible support element 22 upon which the sheet of water impervious material 24 rests. In an alternate embodiment, the flexible support element itself may have a water impervious construction corresponding to the areas where the flexible support element overhangs the bathtub. By forming the flexible support element itself with a water impervious region, the need for the extra sheet of water impervious material can be eliminated.

Figure 4:
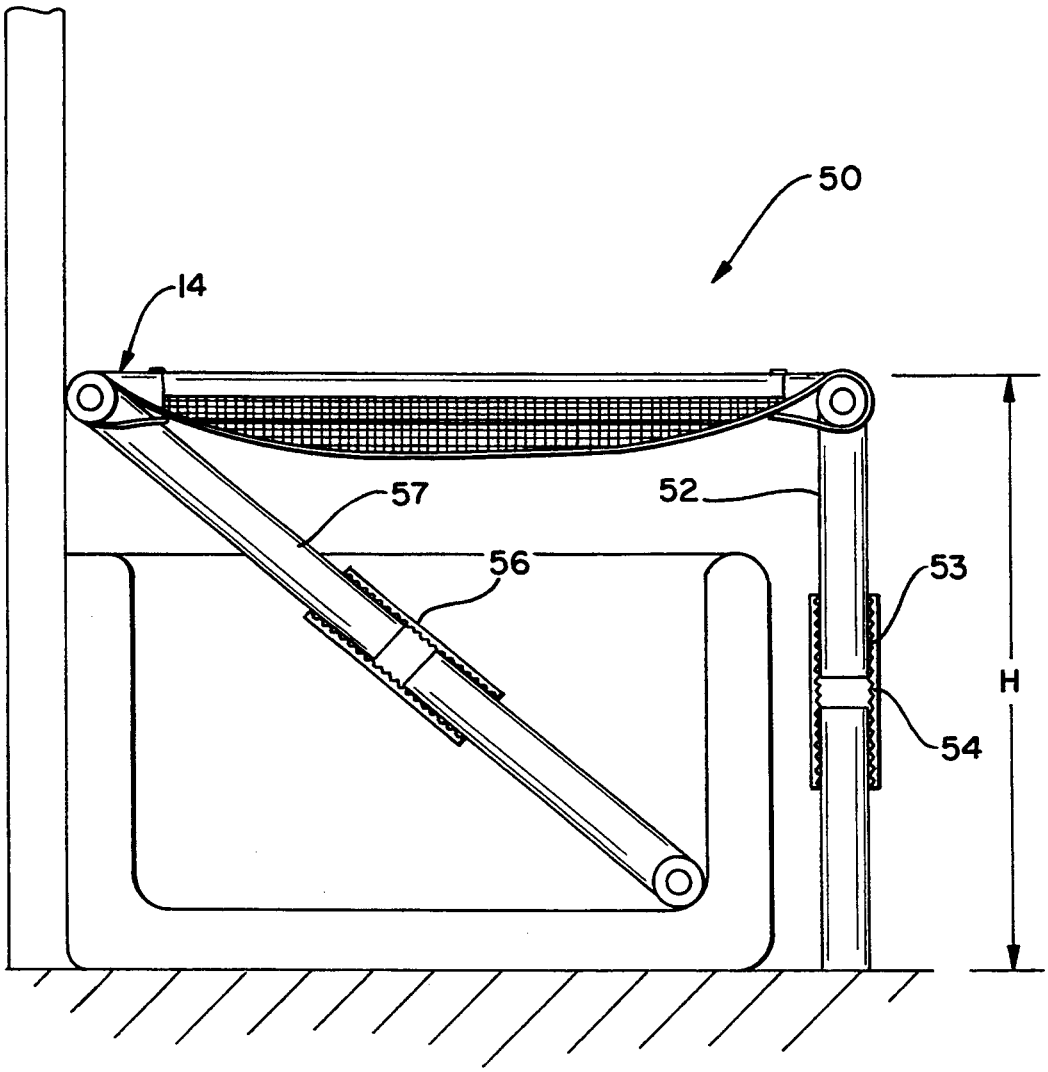
FIG. 4 is a cross-sectional view of an alternate embodiment of the present invention.

Referring to FIG. 4, there is shown an alternate embodiment of the present invention apparatus 50. For the purposes of alternate embodiments described within this description, like parts will be like numbered with regard to the first described embodiment. In the shown embodiment of FIG. 4, the height H at which the planar support 14 is supported above the floor can be selectively varied. People are all different heights. Additionally, there are dimensional differences between many types of bathtubs. To compensate for these variables, a height adjustment means is incorporated into the structure of both/either the two front leg assemblies and/or the rear leg assembly. In the shown embodiment, the front leg assemblies 52 are segmented having an externally threaded region 53. An externally threaded sleeve 54 is threadably joined between the two sections of the segmented leg. As a result, by turning the threaded sleeve 54, the overall length of the two front leg assemblies 52 can be changed as desired. Similarly, two threaded sleeves 56 can also be formed as part of the vertical members 57 of the rear leg assembly. Accordingly, the overall length of the vertical members 57 can also be changed as desired.

It will be understood that the shown use of a threaded sleeve to vary the length of the front leg assemblies and the rear leg assemblies are merely exemplary and any other known means for altering the length of a shaft or leg can be employed. Toward that end, the front leg assemblies and/or the rear leg assembly can be telescopically constructed or otherwise constructed to facilitate any other known means of length adjustment.

Figure 5:
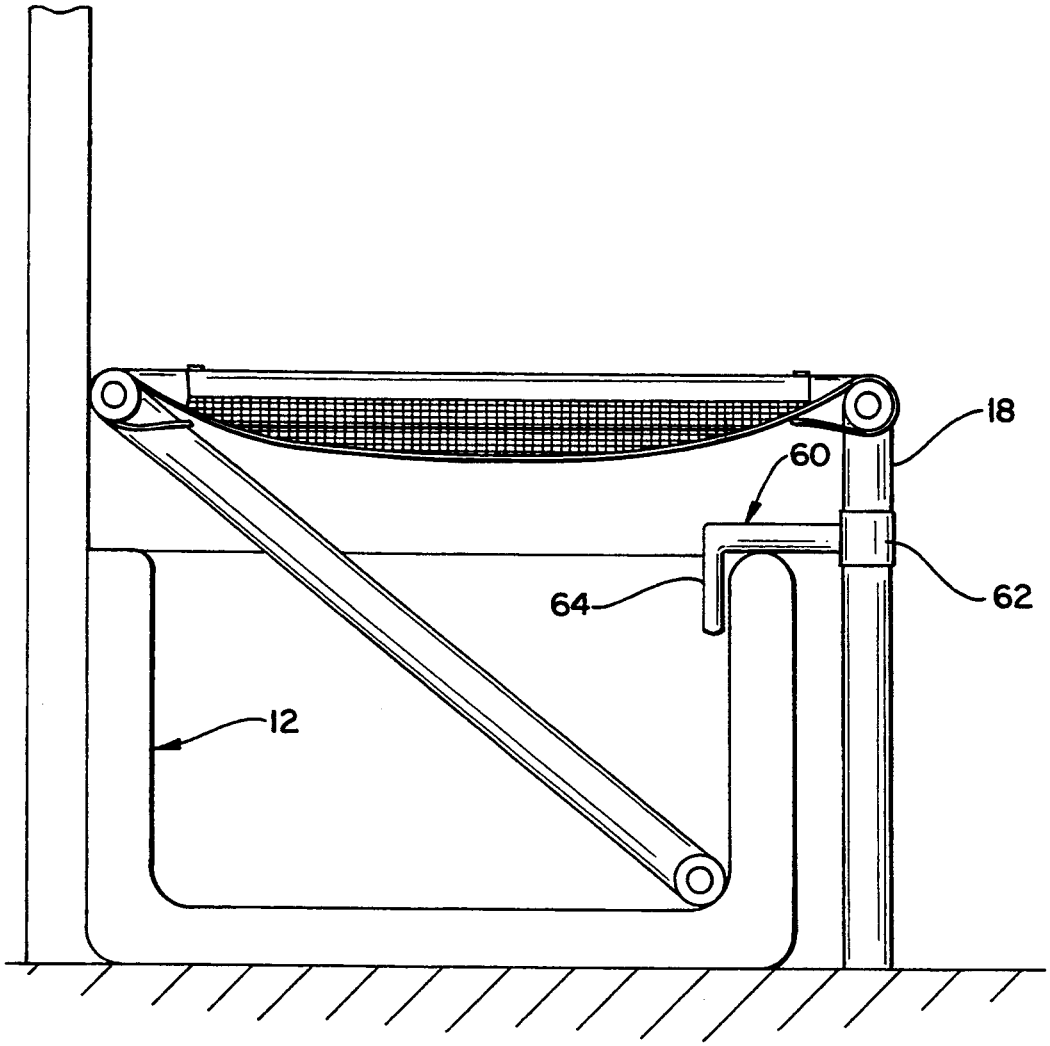
FIG. 5 is a cross-sectional view of a second alternate embodiment of the present invention.

Referring to FIG. 5, a locking device 60 is added to the two front leg assemblies 18. The locking device 60 therein prevents the front leg assemblies 18 from moving away from the bathtub 12. In the shown embodiment, the locking device has a generally L-shape construction, wherein a tubular eyelet 62 is disposed at one end. The front leg assembly 18 passes through the tubular eyelet 62. As a result, the tubular eyelet 62 can move vertically up and down the length of the front leg assembly 18. The foot section 64 of the L-shaped locking device 60 hooks over the forward edge of the bathtub 12. Consequently, the front leg assembly 18 is prevented from moving away from the bathtub 12 as the apparatus is used to support the weight of a disabled person.

Figure 6:
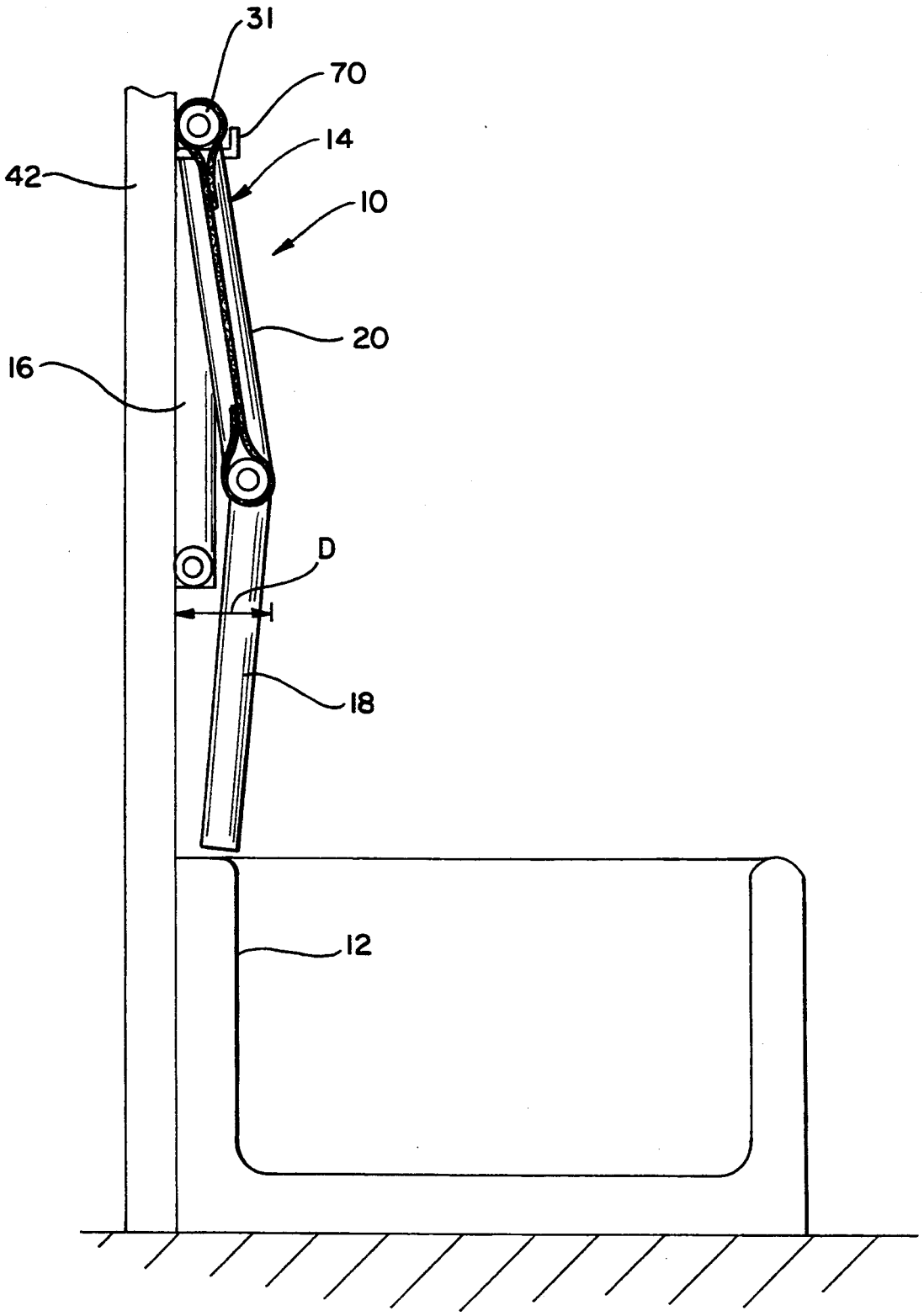
FIG. 6 is a cross sectional view of the embodiment shown in FIG. 1, wherein the present invention is folded into its stowed position above a bathtub.

Referring to FIG. 6. the present invention apparatus is shown in its stowed position, wherein the rear leg assembly 16, and the front leg assemblies 18 have been folded into the same general plane as the planar support 14. Hooks 70 are positioned on the wall 42 behind the bathtub 12. As can be seen the hooks 70 are adapted to hold the distal element 31 of the rectangular frame 20. When the present invention apparatus 10 is not in use the planar support 14 can be rotated into a vertical plane whereby the distal element 31 of the rectangular frame 20 is placed on the hooks 70. Once in this position, gravity causes the rear leg assembly 16 to fold against the planar support 14. Similarly, the two front leg assemblies 18 dangle below the planar support 14 in the same general plane as the planar support 14. This folded configuration allows the apparatus to extend only a small distance D from the wall 42. This position of the present invention apparatus 10 is unobtrusive and allows the bathtub 12 to be used as normal. To use the apparatus 10, the apparatus 10 is removed from the hooks 70 and the planar support is rotated into a horizontal plane. Gravity rotates the rear leg assembly 16 and the two front leg assemblies 18 into positions needing only minor manipulative adjustments. The manipulation of the present invention apparatus 10 from the folded configuration of FIG. 6 to the unfolded configuration of FIG. 1 or vice versa would take less than one minute.

It will be understood that the embodiments described herein are merely exemplary and that a person skilled in the art may make many variations and modifications to the described embodiments utilizing functionally equivalent components to those described. All such variations and modifications are intended to be included within the scope of this invention as defined by the appended claims.

What is claimed is:

1. A bathing support apparatus for supporting a person a predetermined height above a bathtub, wherein said bathtub, has a rear wall which abuts against a supporting wall and a front wall parallel to said rear wall, comprising:

a water pervious platform capable of supporting an adult in a supine position wherein a rearward portion of said platform abuts against said supporting wall;

at least one forward leg assembly coupled to said platform, wherein said at least one forward leg assembly engages the floor proximate the bathtub; and a rearward leg assembly coupled to said platform, wherein said a rearward leg assembly includes a generally U-shaped member having two vertical elements and a connecting cross-member, wherein said cross-member is adapted to engage a bottom of the bathtub proximate said front wall, said a rearward leg assembly and said at least one forward leg assembly supporting said platform at said predetermined height above said platform.

2. The apparatus according to claim 1, wherein said platform includes a flexible support suspended between a rigid peripheral frame.

3. The apparatus according to claim 2, wherein said frame lays in substantially one plane and said at least one forward leg assembly is pivotably coupled to said frame.

4. The apparatus according to claim 3, further including a locking means for locking said at least one forward leg assembly in an orientation generally perpendicular to the plane of the frame, wherein said at least one forward leg assembly supports said frame in a generally horizontal plane when said at least one forward leg assembly engages the floor proximate the bathtub.

5. The apparatus according to claim 3, further including a connecting means for connecting said at least one forward leg assembly to the bathtub, said connecting means thereby preventing said at least one forward leg assembly from accidentally moving away from said bathtub.

6. The apparatus according to claim 3, wherein said a rearward leg assembly is pivotably coupled to said frame, said a rearward leg assembly and said at least one forward leg assembly being foldable against said platform so as to lay in substantially the same plane as said frame.

7. The apparatus according to claim 1, further including a first adjustment means for selectively adjusting the length of said a rearward leg assembly.

8. The apparatus according to claim 7, further including a second adjustment means for selectively adjusting the length of said at least one forward leg assembly.

9. The apparatus according to claim 1, further including a means for selectively adjusting said predetermined height at which said at least one forward leg assembly and said a rearward leg assembly support said platform above the bathtub.

10. The apparatus according to claim 1 being made of at least one material that is none corrosive in water.

11. The apparatus according to claim 1, wherein the platform overhangs the bathtub and the apparatus further includes a water impervious member positionable over said platform in at least one area of said platform that overhangs said tub.

12. The apparatus according to claim 1, wherein said vertical elements are pivotably connected to said platform.

13. The apparatus according to claim 1, wherein said rearward portion is of a predetermined length and said rearward portion contacts said supporting wall generally across said predetermined length.

14. An apparatus for supporting a person over a bathtub, wherein said bathtub is supported on a floor and has a rear wall which abuts against a supporting wall and a front wall parallel to said rear wall, comprising:

a platform that includes an elongated rearward member, an elongated forward member and a flexible support element suspended therebetween wherein said rearward member abuts against said supporting wall;

a plurality of rear legs pivotable coupled to said rearward member, wherein said rear legs are adapted to engage a bottom surface of said bathtub proximate said front wall and support said rearward member a predetermined height above the bathtub;

a plurality of front legs pivotably coupled to said forward member, wherein said front legs extend to a surface outside of the bathtub and support said forward member said predetermined height above the bathtub.

15. The apparatus of claim 14, further including a means for coupling said front legs to the bathtub, thereby preventing said front legs from moving away from the bathtub beyond a predetermined limit.

16. The apparatus according to claim 14, wherein said platform is generally planar and said rear legs and said front legs are foldable into generally the same plane as said platform.

17. The apparatus according to claim 14, wherein said rear legs are interconnected by a cross-member that engages the bottom surface of the bathtub.

18. The apparatus according to claim 14, wherein said platform overhangs said bathtub, said flexible support element being water impervious in the areas that overhang the bathtub and being water pervious in areas above said bathtub.

19. The apparatus according to claim 14, further including an adjustment means for adjusting said predetermined height said platform is supported above the bathtub.

* * * * *